US005308146A

United States Patent [19]

Chou

[11] Patent Number: 5,308,146

[45] Date of Patent: May 3, 1994

[54] COMBINATION CHAIR

[76] Inventor: Shin C. Chou, No. 11, Lane 195, An Kang Road, Hsin Hen City, Taipei Hsien, Taiwan

[21] Appl. No.: 935,918

[22] Filed: Aug. 27, 1992

[51] Int. Cl.[5] ..... A47C 7/00

[52] U.S. Cl. ..... 297/440.16; 297/233; 297/118

[58] Field of Search ..... 297/443, 440, 233, 232, 297/238, 239, 1, 118, 217, 463

[56] References Cited

U.S. PATENT DOCUMENTS

| | | | |
|---|---|---|---|
| 600,812 | 3/1898 | Swanson | 297/234 |
| 1,530,420 | 3/1925 | Schmitt | 297/233 X |
| 1,660,119 | 2/1928 | Decker | 297/233 X |
| 2,456,794 | 12/1948 | Richardson | 297/443 |
| 2,669,285 | 2/1954 | Young | 297/443 X |
| 3,205,839 | 9/1965 | Norreklit | 297/239 X |
| 3,841,701 | 10/1974 | Sullivan | 297/443 X |
| 4,208,072 | 6/1980 | Iskendarian | 297/239 X |

FOREIGN PATENT DOCUMENTS

| | | | |
|---|---|---|---|
| 0517555 | 2/1953 | Belgium | 297/239 |
| 0093816 | 9/1897 | Fed. Rep. of Germany | 297/239 |
| 0278527 | 7/1913 | Fed. Rep. of Germany | 297/118 |

*Primary Examiner*—Kenneth J. Dorner
*Assistant Examiner*—Milton Nelson, Jr.
*Attorney, Agent, or Firm*—Morton J. Rosenberg; David I. Klein

[57] ABSTRACT

A combination chair is provided which includes a top chair stacked on a base chair and releasably coupled thereto by respective male and female fasteners. A first back chair and a second back chair, releasably coupled together are respectively fastened to the top chair and the base chair through sleeve joints. Therefore, the top chair, the base chair, the first back chair and the second back chair may be disconnected from one another for use separately, or connected together, to form a single chair, thereby reducing storage space requirements.

1 Claim, 3 Drawing Sheets

COMBINATION CHAIR

BACKGROUND OF THE INVENTION

The present invention relates to chairs. More particularly, the present invention is directed to a combination chair which combines four chair units into a single chair assembly, so that such can be arranged into any of a variety of combinations according to the number of persons who are to be seated.

A chair is simply designed for an individual to sit on, and in order to accommodate more people, more chairs are required. However, much space is required if the number of chairs required to accommodate a maximum number of guests is maintained.

SUMMARY OF THE INVENTION

The present invention eliminates the aforesaid problem. It is therefore an object of the present invention to provide a combination chair which combines four independent chairs into a single chair assembly so that it can be alternately arranged into either of four combinations for serving one to four persons.

BRIEF DESCRIPTION OF THE DRAWINGS

FIG. 3 illustrates the combination chair separated into four independent chairs for use separately.

DETAILED DESCRIPTION OF THE PREFERRED EMBODIMENT

Figure 1:
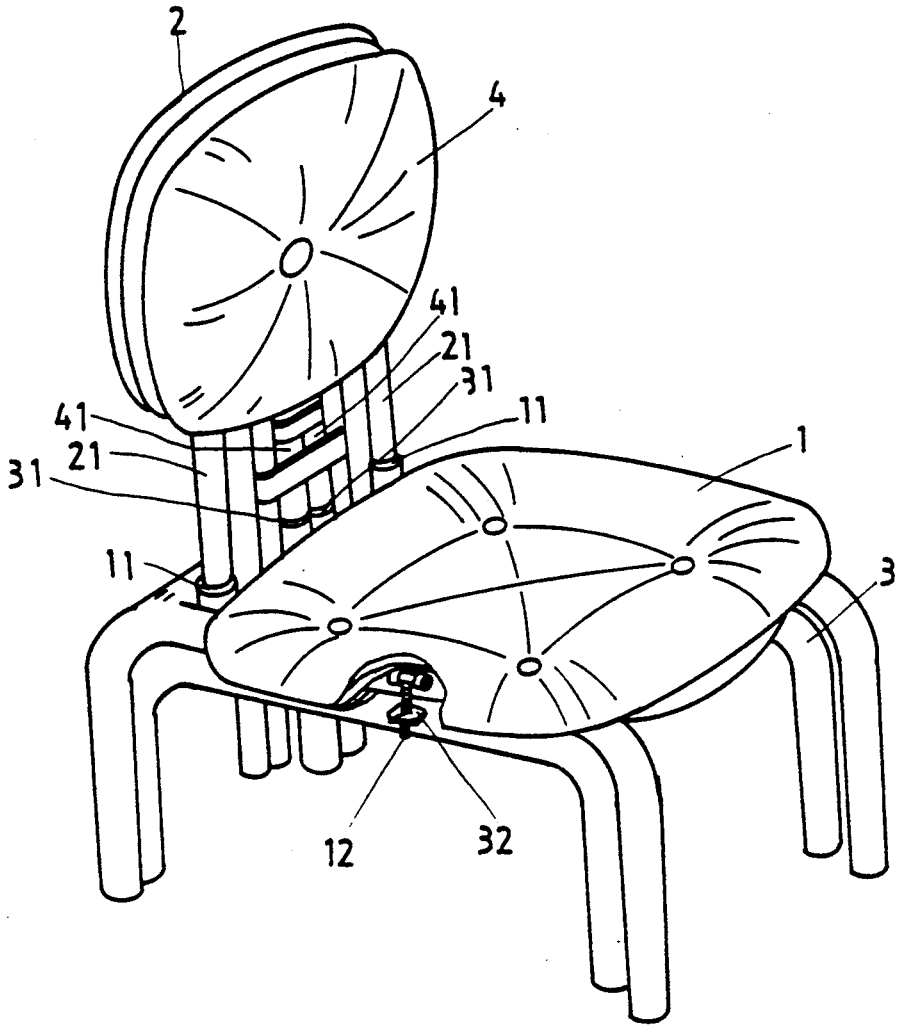
FIG. 1 is an elevational view of the preferred embodiment of the combination chair of the present invention.
Figure 2:
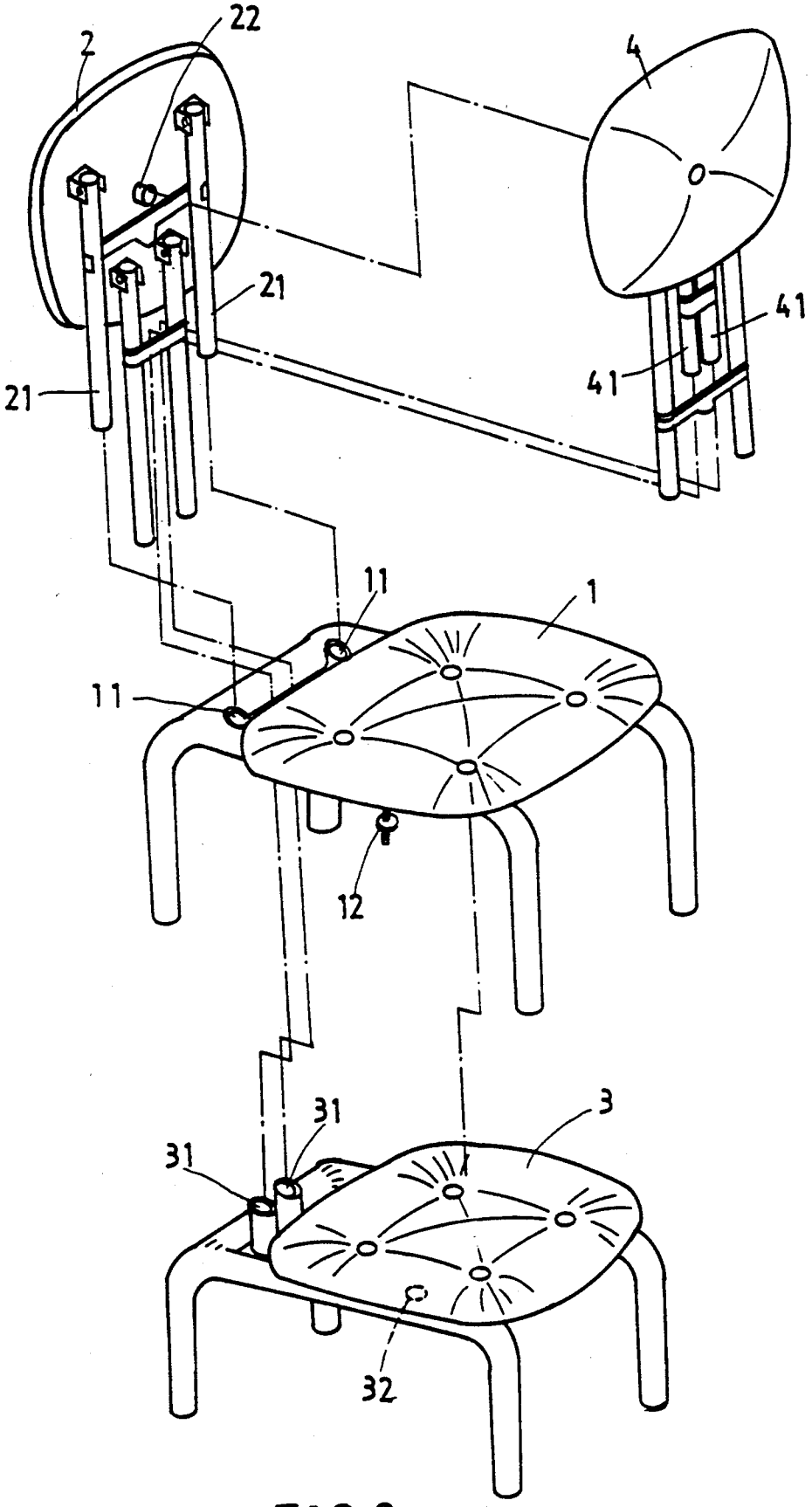
FIG. 2 is an exploded view thereof.

Referring to FIGS. 1 and 2, the combination chair assembly consists of four individual chairs, namely, the base chair 3, the top chair 1, the first back chair 4 and the second back chair 2. The top chair 1 and the base chair 3 are arranged in a stacked relation, and releasably locked together as a single seat by male and female fasteners 12, 32. The first back chair 4 and the second back chair 2 are attached together back to back by means of a releasable coupling, the coupling element 22 mating with a complementary element disposed on the back side of the back chair 4 (not shown). The two chair backs are fastened to the top chair 1 and the base chair 3, on one side thereof and in a vertical position, forming the back of the single chair assembly. The first back chair 4 and the second back chair 2 each has a respective set of folding legs 21, 41. By inserting one pair of folding legs 21, 41 into a respective pair of locating sleeves 11, 31 disposed on the back end of chair 1, 3, the first and second back chairs 4, 2 thereby being retained to the seat formed by the stacked engagement of the base chair 3 and the top chair 1.

Figure 3A:
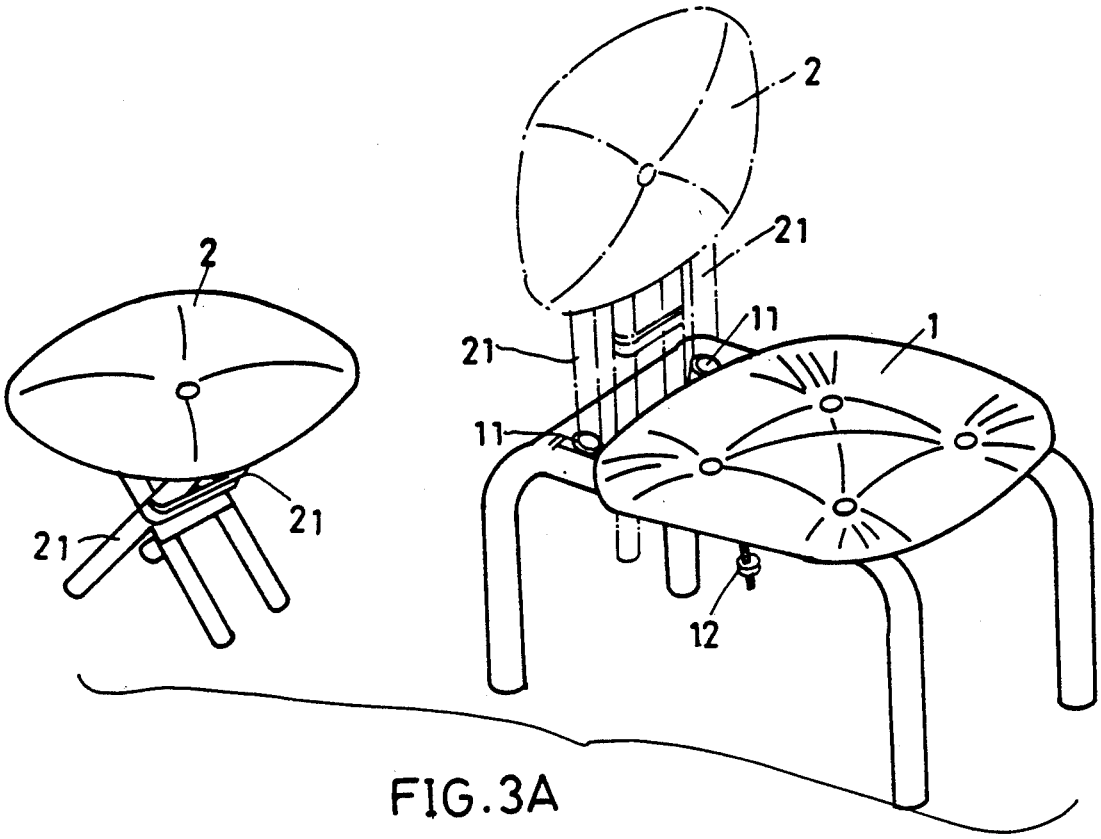
FIG. 3A is a perspective view of a second back chair detached from a top chair.
Figure 3B:
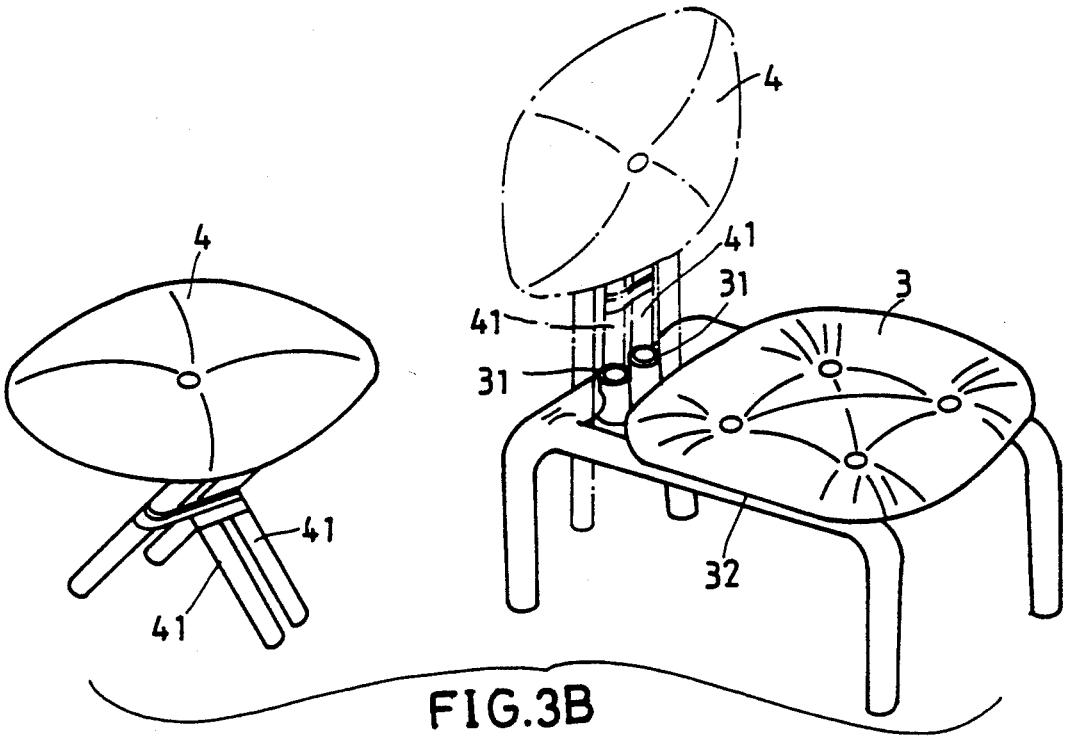
FIG. 3B is a perspective view of a first back chair det

Referring to FIGS. 3A and 3B, the first and second back chairs 4, 2 may be detached from the base chair 3 and the top chair 1 for use separately. By unfastening the male fasteners 12 from the female fasteners 32, the top chair 1 is disconnected from the base chair 3, and therefore the top chair 1 and the base chair 3 can be separately used, as can back chairs 4 and 2 with their legs unfolded.

I claim:

1. A combination chair, comprising:

a base chair having a first back end portion extending between opposing first sides thereof;

a top chair having a second back end portion extending between opposing second sides thereof, said top chair being stackable on said base chair;

means for releasably lockingly coupling said top chair on said base chair in a stack, said releasable locking means including complementary fastening members coupled to respective said first and second sides of said base and top chairs;

a first back chair having two pairs of legs pivotedly coupled to a bottom surface thereof, said two pairs of legs having mean for folding to extend substantially parallel to said bottom surface of said first back chair and one of said two pairs of legs being insertable through an opening in said second back end portion for releasable coupling with a pair of first sleeve members secured to said first back end portion of said base chair; and, a second back chair having two pairs of legs pivotedly coupled to a bottom surface thereof, said two pairs of legs of said second back chair having means for folding to extend substantially parallel said bottom surface of said second back chair and one of said two pairs of legs of said second back chair being insertable into a pair of second sleeve members secured to said second back end portion of said top chair for releasable coupling therewith, said first and second back chairs being respectuvely coupled to said stacked base and top chairs with said bottom surface of said first back chair facing said bottom surface of said second back chair to form a single chair unit, whereby said first and second back chairs are separable from said stacked top and base chairs and said top chair is separable from said base chair to yield four independent chairs.

* * * * *